US006532354B2

(12) United States Patent
Maher et al.

(10) Patent No.: US 6,532,354 B2
(45) Date of Patent: Mar. 11, 2003

(54) CLEANING BRUSH FOR ELECTROSTATOGRAPHIC IMAGING APPARATUS AND APPARATUS CONTAINING SAME

(76) Inventors: James C. Maher, 5912 Breckenridge Pkwy., Tampa, FL (US) 33619; Douglas C. Anderson, 1447 St. Paul St., Rochester, NY (US) 14653-7002; Theodore H. Morse, 60 Harvington Dr., Rochester, NY (US) 14617; Jiann H. Chen, 1447 St. Paul St., Rochester, NY (US) 14653-7002; Robert A. Guistina, Bldg. 82/RL, 1999 Lake Ave., Rochester, NY (US) 14650-2141

( * ) Notice: Subject to any disclaimer, the term of this patent is extended or adjusted under 35 U.S.C. 154(b) by 0 days.

(21) Appl. No.: 09/912,160

(22) Filed: Jul. 24, 2001

(65) Prior Publication Data

US 2003/0031489 A1 Feb. 13, 2003

(51) Int. Cl.[7] ..... G03G 21/00
(52) U.S. Cl. ..... 399/353
(58) Field of Search ..... 399/353, 354

(56) References Cited

U.S. PATENT DOCUMENTS

| | | | | |
|---|---|---|---|---|
| 4,097,140 A | 6/1978 | Suzuki et al. | ..... | 399/353 |
| 4,319,831 A | 3/1982 | Matsui et al. | ..... | 399/353 |
| 4,540,746 A | 9/1985 | Roberts | ..... | 525/408 |
| 4,835,807 A | 6/1989 | Swift | ..... | 399/353 X |
| 5,466,406 A | 11/1995 | Liu | ..... | 264/103 |
| 5,525,243 A | 6/1996 | Ross | ..... | 252/8.81 |
| 5,689,791 A | 11/1997 | Swift | ..... | 399/353 |
| 6,009,301 A | 12/1999 | Maher et al. | ..... | 399/353 |

OTHER PUBLICATIONS

Solutia, Inc., "No–Shock Conductive Fibers", http:///www-.solutia.com/products/noshock.html, pp. 1–16, (May 2, 2001).

*Primary Examiner*—Fred L Braun
(74) *Attorney, Agent, or Firm*—Lawrence P. Kessler

(57) ABSTRACT

A photoreceptor cleaning brush for an electrostatographic imaging apparatus contains individual fibers provided with a finishing agent that is a water-miscible aliphatic organic compound containing a plurality of alcoholic hydroxy substituents. The finishing agent is selected from the group of compounds having a molecular weight of up to about 250 and polyethylene glycols having a number-average molecular weight of about 1000 to about 200,000. In an electrostatographic imaging apparatus, the photoconductive imaging element includes the described photoreceptor cleaning brush and a photoconductive surface portion that contains a polycarbonate binder resin. The cleaning brush removes toner from the photoconductive surface portion of the element without damaging it.

34 Claims, 2 Drawing Sheets

CLEANING BRUSH FOR ELECTROSTATOGRAPHIC IMAGING APPARATUS AND APPARATUS CONTAINING SAME

FIELD OF THE INVENTION

The present invention relates to electrostatography and, more particularly, to cleaning brushes for use in electrostatographic imaging apparatus.

BACKGROUND OF THE INVENTION

In known electrostatographic imaging apparatus, a photoconductive insulating element is typically charged to a uniform potential and thereafter exposed to a light image of an original document to be reproduced. The exposure discharges the photoconductive insulating surface in exposed or background areas and creates on the photoconductive element an electrostatic latent image that corresponds to the image contained within the original document. Alternatively, a light beam may be modulated and used to selectively discharge portions of the charged photoconductive surface to record the desired information thereon. Subsequently, the electrostatic latent image on the photoconductive insulating surface is made visible by developing the image with developer powder referred to in the art as toner. Most development systems employ developer comprising charged carrier particles and charged toner particles that triboelectrically adhere to the carrier particles. During development, the toner particles are attracted from the carrier particles by the charged pattern of the image areas of the photoconductive insulating element to form a powder image thereon. This toner image may be subsequently transferred to a support surface such as copy paper, to which it may be permanently affixed by heating and/or the application of pressure. Usually, all of the developed toner does not transfer to the copy paper, and therefore cleaning of the photoconductive surface is required prior to its entering the next charge and expose cycle.

Commercial embodiments of the apparatus generally described above have taken various forms that entail particular techniques for cleaning the insulating surface of the photoconductive member. One of the most common and commercially successful cleaning techniques has been the use of a cylindrical brush with soft bristles having suitable triboelectric characteristics. The bristles are soft so that, as the brush is rotated in contact with the photoconductive surface to be cleaned, the fibers continually wipe across the surface to produce the desired cleaning without causing significant surface wear or abrasion.

Further developments in cleaning techniques and apparatus, in addition to relying on the physical contacting of the surface to be cleaned to remove the toner particles, also entail establishing electrostatic fields by electrically biasing one or more members of the cleaning system to establish a field between a conductive brush and the insulative imaging surface and thereby cause the toner on the imaging surface to be attracted to the brush by electrostatic forces. Thus, if the toner on the photoreceptor is positively charged, the bias on the brush would be negative. The creation of a sufficient electrostatic field between the brush and imaging surface to achieve the desired cleaning effect is accomplished by applying a DC voltage to the brush. Typical examples of such techniques are described in U.S. Pat. Nos. 3,572,923 and 3,722,018.

U.S. Pat. No. 4,319,831, the disclosure of which is incorporated herein by reference, describes a cleaning brush for a copying device wherein the brush is composed of composite conductive fibers consisting of at least one conductive layer containing conductive fine particles and at least one non-conductive layer in a monofilament. The electrical resistance of the conductive fibers is less than $10^{15}$ ohms/cm. The fineness of the fibers is from 3 to 300 denier and the length of the piles is from 3 to 50 mm. The percentage of the outer surface area occupied by the conductive layer is not more than 50%. Conductive carbon black particles may be used with a number of synthetic resins, including polyaraides. Other cleaning brushes containing electroconductive fibers are described in U.S. Pat. Nos. 4,835,807, 5,689,791, and 6,009,301, the disclosures of which are incorporated herein by reference.

SUMMARY OF THE INVENTION

The present invention is directed to a cleaning brush for use in an electrostatographic imaging apparatus. The cleaning brush comprises individual fibers provided with a finishing agent comprising a water-miscible aliphatic organic compound containing a plurality of alcoholic hydroxy substituents. The finishing agent is selected from the group of organic compounds having a molecular weight of up to about 250 and polyethylene glycols having a number-average molecular weight of about 1000 to about 200,000.

The present invention is further directed to an improved electrostatographic imaging apparatus that includes a photoconductive imaging element and a cleaning brush. The improvement comprises: the photoconductive imaging element having a photoconductive surface portion comprising a polycarbonate binder resin, and the cleaning brush comprising individual electroconductive fibers provided with a finishing agent comprising a water-miscible aliphatic organic compound containing a plurality of alcoholic hydroxy substituents and having a molecular weight of up to about 250. The finishing agent is selected from among organic compounds having a molecular weight of up to about 250 and polyethylene glycols having a number-average molecular weight of about 1000 to about 200,000. The cleaning brush removes toner from the photoconductive surface portion of said imaging element without damaging it.

DETAILED DESCRIPTION OF THE INVENTION

A trend has developed in the electrostatographic/copier industry to construct an apparatus using subsystems developed and manufactured by several different vendors. Cleaning, charging, development, and fusing components are examples of subsystems that can be purchased separately for assembly in a copier/printer mainframe. Photoconductive insulating elements that include polycarbonates as binder resins are commercially available from several sources, including AEG of Germany and Fuji Electric of Japan. MCA, also of Japan, supplies photoconductive elements whose binder resins comprise a polycarbonate-polyester blend.

Cleaning brushes for electrostatographic imaging apparatus can be fabricated from a variety of fibers, both natural and synthetic. The later category includes materials such as polyamides, polyesters, polyolefins, polyacrylics, and polyvinyls. Preferred materials, however, include electroconductive composite antistatic fibers such as those described in the previously discussed U.S. Pat. No. 4,319,831. These composite fibers, which can comprise, for example, a conductive core encompassed by an insulative sheath or a non-conductive core provided with a conductive outer layer, are available from several commercial sources. DuPont, for example, has sold a fiber under the name NEGASTAT®, which has a carbon-loaded polyurethane conductive core and a polyester insulating sheath. Similarly, Solutia, Inc. sells a fiber under the name NO-SHOCK®, which comprises a carbon-loaded Nylon 6 core and an insulative sheath of Nylon 6,6. BASF Corporation is a source for F901 Static Control yarn, which have an insulative polymeric core and an annular region containing electrically conductive particles.

Figure 2:
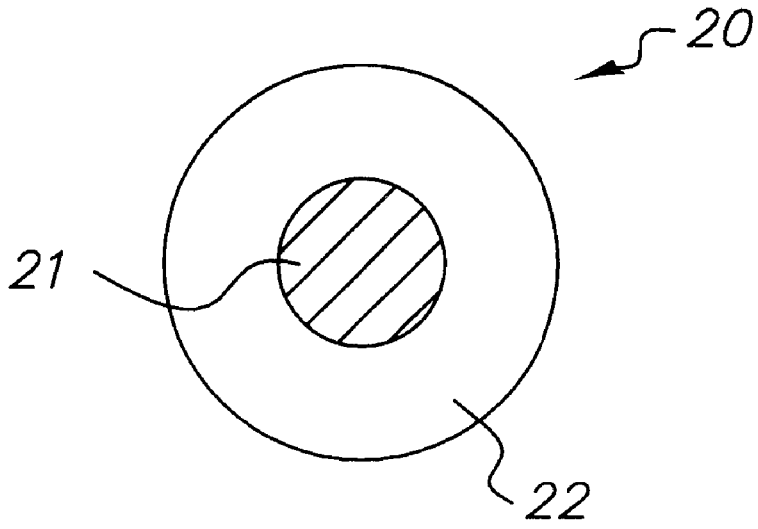
FIGS. 2 and 3 represent cross-sections of electroconductive fibers usefull for the cleaning brush of the present invention.
Figure 3:
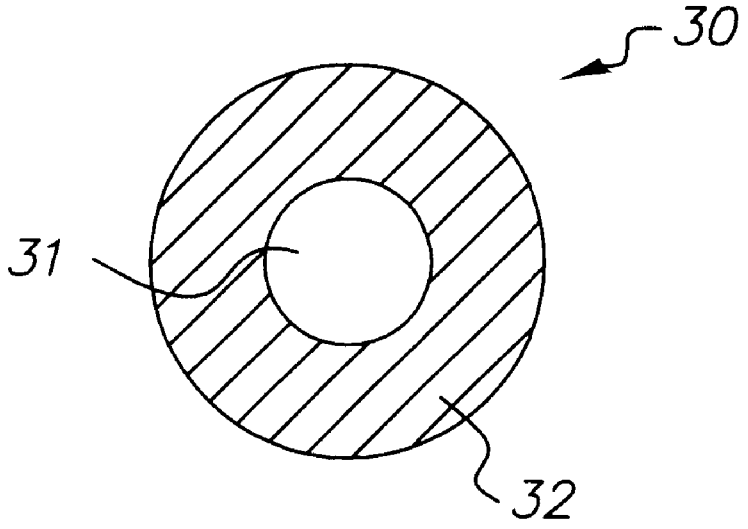

FIG. 2 is a schematic cross-sectional view of an electroconductive fiber 20 having a conductive core 21 and an insulating sheath 22. FIG. 3 depicts the cross-section of an electroconductive fiber 30 having a non-conductive core 31 and a conductive sheath 32.

Figure 1:
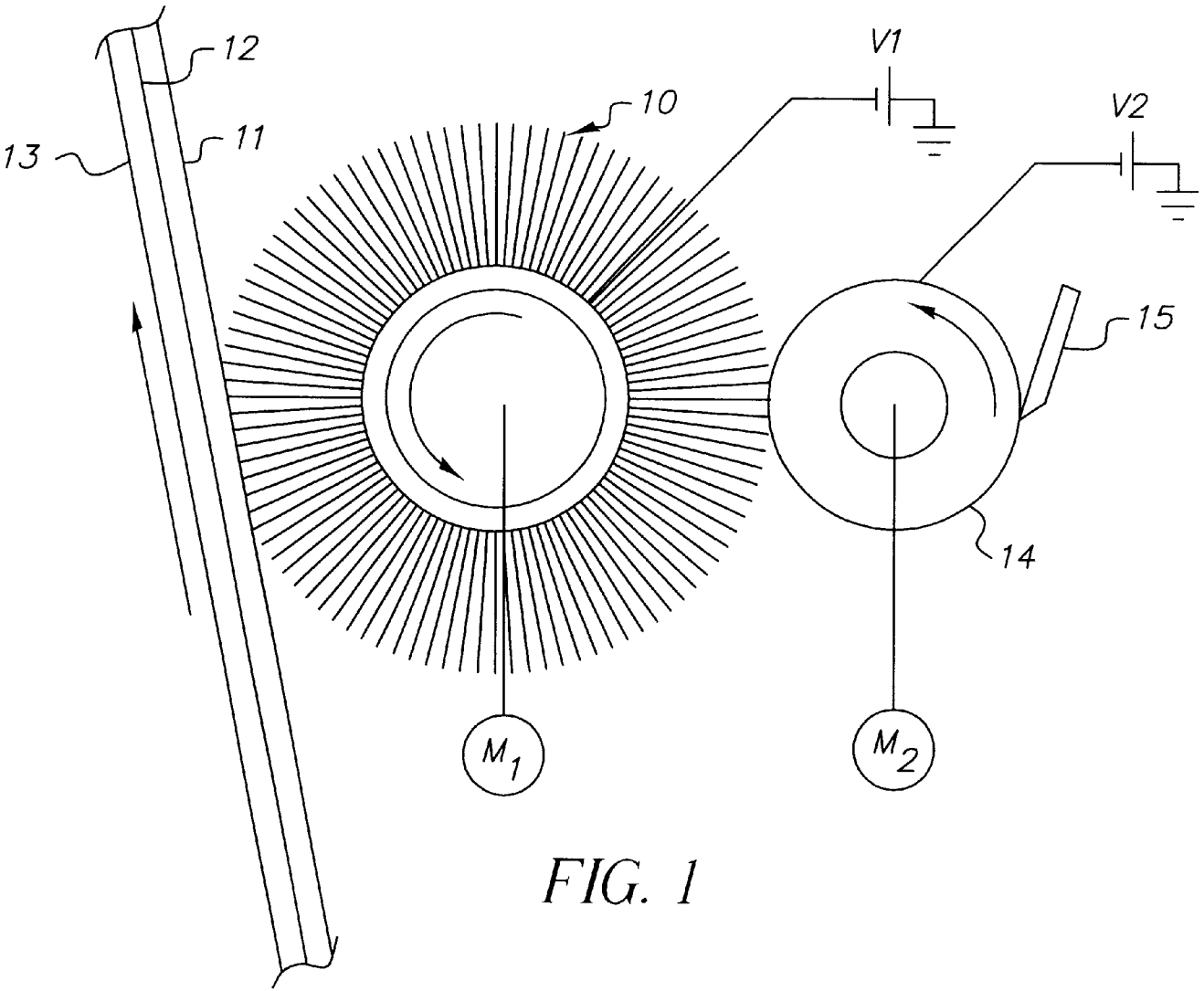
FIG. 1 is a schematic illustration of the cleaning brush of the present invention included in an electrostatographic imaging apparatus.

As illustrated in FIG. 1, a cleaning station comprises an electrically conductive fiber brush 10 that is supported for rotation in contact with the photoconductive surface portion 11 of photoconductive imaging element 12 by a motor $M_1$. A source $V_1$ of negative DC potential is operatively connected to brush 10 such that an electric field is established between the insulating support 13 and brush 10, thereby causing attraction of the positively charged toner particles from surface portion 11. In accordance with the present invention, photoconductive surface portion 11 includes a polycarbonate binder resin and may further include a polyester resin.

Typically, a voltage of the order of negative 250 volts is applied to brush 10. An insulating detoning roll 14 is supported for rotation in contact with conductive brush 10 and rotates at about twice the speed of brush 10. A source of DC voltage $V_2$ electrically biases a detoning roll 14 to a higher potential of the same polarity as brush 10 is biased. A scraper blade 15 contacts roll 14 for removing the toner therefrom. Detoning roll 14, which is supported for rotation by a motor $M_2$, is typically fabricated from anodized aluminum, and its surface contains a thin oxide layer that is capable of leaking charge to preclude excessive charge buildup on roll 14. The primary cleaning mechanism depends on electrostatic attraction of toner to the tips of the brush fibers, from which it is removed by detoning roll 14. Blade 15 scrapes the collected toner off detoning roll 14 to an auger (not shown) that transports the toner to a sump (not shown).

Fibers useful for cleaning brushes are typically formed by melting the spinning material, extruding the melt, and cooling the spun fibers, which can be further subjected to a drawing process to thin them. Using conventional techniques such as those described in the previously mentioned U.S. Pat. Nos. 4,835,807 and 5,689,791, the fibers are formed into yarns by twisting followed preferably by hydrosetting. The yarns are then knit or, preferably, woven into strips provided with a backing layer. The strips are then cut to produce a cut plush pile that can be utilized to prepare a cleaning brush, preferably by adhering the plush pile to a cylindrical core. The woven strip may also be made to include both an upper and lower backing layer; cutting of this strip produces two pile fabrics, each disposed on a backing layer, for inclusion in a cleaning brush in accordance with the present invention.

In the preparation of fibers, including the preferred composite conductive fibers, a finishing agent is applied, typically immediately after extrusion. The finishing agent, which can be applied to the fiber either by immersion in a bath or by contact with a roller containing the agent, facilitates the subsequent operations of brush manufacture.

Spin finishing is extensively discussed in Philip E. Slade, *Handbook of Fiber Finish Technology,* 1998, Marcel Dekker, N.Y. As discussed at page 6 of the Slade treatise, finishing agents consist of one or more components that act as lubricants, emulsifiers, cohesive agents, and antistatic agents. Furthermore, they should have good wetting characteristics and be soluble or emulsifiable in water, and should be chemically inert towards the fiber. Commonly used finishing agents include waxes, mineral oils, hydrocarbon oils, fluorocarbons, silicone materials such as silicone oils and polyorganosiloxanes. In chapters 4 and 5 of the Slade treatise are described as useful components of finishing agents a variety of esters and ethers of fatty acids and alcohols, including fatty acid esters of ethylene and propylene glycol, glycerol, and polyethylene glycols (PEG esters) and fatty alcohol ethers derived from poly(ethylene oxide) (POE-alcohols).

Fiber finishing agents that include polyhydroxysubstituted components are known. U.S. Pat. No. 5,525,243, discloses a high cohesion finish composition that contains about 15 to 50 weight percent of a polyethylene glycol having a molecular weight in the range of about 200 to 1000, about 5 to 30 weight percent of an antistatic agent, about 0 to 80 weight percent of an emulsifier, and the remainder a lubricant.

U.S. Pat. No. 4,540,746 discloses a polyamide fiber comprising, as a distinct phase, about 0.4 to 10 weight percent, based on the weight of the polyamide, of a mixture consisting essentially of about 75 to 95 weight percent of a low molecular weight polyethylene glycol having an average molecular weight of about 1000 to 6000 and about 25 to 5 weight percent of a high molecular weight polyethylene glycol having an average molecular weight of about 70,000 to 1,000,000. The polyethylene glycol mixture is added to the molten polyamide prior to extrusion.

U.S. Pat. No. 5,466,406 discloses a process for spin finishing a fiber for use in fabricating a surgical device in which a solution of glycerol in a solvent such as water or an alcohol is applied to filaments that are then gathered to produce a yarn.

When a cleaning brush fabricated from commercial composite antistatic fibers finished with a conventional commercial finishing agent was employed to clean a photoconductive insulating element having a polycarbonate or a polycarbonate-polyester blend as the binder resin, substantial damage, in the form of "crazing" or cracking of the photoconductor surface was observed. Several components of conventional finishing agents were identified as possible causes of crazing, including oleic acid, $C_{16}$ to $C_{18}$ fatty acids and corresponding esters thereof, and Silwet materials, which are reaction products of polydimethylsiloxanes and polyethylene glycol. Although the precise nature of the photoconductor surface damage is not understood, it is believed to be the result of an undesirable interaction between the binder resin and the finishing agent employed during formnation of the brush fibers.

An effort was undertaken to identify suitable finishing agents that would not damage the surface of the photoconductive element. To this end, 2-ply cotton disks with a diameter of 18 mm were saturated with various candidate compounds and adhered, using masking tape, to the surface of photoconductive drums obtained from Fuji Electric and MCA. The drums, with the adhered disks, were returned to their shipping containers to shield them from light and were stored at ambient temperature for specified periods of time ranging from 24 to 96 hours. The drums were then examined to determine the effect of the various compounds on the photoconductive surface and the results evaluated. A total absence of observable crazing was designated with a rating of "1". The most severe crazing was assigned a rating of "10", and intermediate levels of crazing were given ratings between 1 and 10. It is recognized that this test represents extreme conditions in terms of the concentration and exposure time of the photoconductive surface to the finishing compound but nonetheless is of value for distinguishing potentially useful materials from unpromising ones. The results are summarized in the following table:

| | Fuji Drum | | | | MCA Drum | | | |
|---|---|---|---|---|---|---|---|---|
| Compound | 24 hr | 42 hr | 72 hr | 96 hr | 24 hr | 42 hr | 72 hr | 96 hr |
| ethylene glycol | 1 | | | 1 | 1 | | | 1 |
| diethylene glycol | 1 | | | 1 | 1 | | | 1 |
| triethylene glycol | 1 | | | 1 | 1 | | | 1 |
| tetraethylene glycol | 1 | | | 2 | 1 | | | 1 |
| dipropylene glycol | 1 | | | 5 | 1 | | | 1 |
| tripropylene glycol | 2 | | | 9 | 1 | | | 2 |
| diethylene glycol diethyl ether | 10 | | | 10 | 10 | | | 10 |
| 1,3-propanediol | 1 | | 1 | | 1 | | 2 | |
| 1,2-propanediol | 1 | | 1 | | 1 | | 1 | |
| 2,2-bis(hydroxymethyl)propionic acid | | 1 | | | | 1 | | |
| 2-aminoethanol | 10 | | 10 | | 10 | | 10 | |
| 1,5-pentanediol | 1 | | 1 | | 1 | | 1 | |
| 1,6-hexanediol | | 1 | | | | 1 | | |
| 1,2-hexanediol | 1 | | 1 | | 6 | | 1 | |
| neopentyl glycol | | 2 | | | | 1 | | |
| glycerol | 1 | | 1 | | 1 | | 1 | |
| 1,4-butanediol | 1 | | 1 | | 1 | | 1 | |
| diethanolamine | 1 | | 1 | | 1 | | 1 | |
| tris(hydroxymethyl)amine | | 1 | | | | 1 | | |
| 1,2,4-butanetriol | 1 | | 1 | | 1 | | 1 | |
| polyethylene glycol ($M_n$ 600) | | | | 5 | | | | 10 |
| polyethylene glycol ($M_n$ 1050) | | 1 | | | | 1 | | |
| polyethylene glycol ($M_n$ 10,000) | | 1 | | 2 | | 1 | | 1 |
| polyethylene glycol ($M_n$ 200,000) | | 1 | | | | 1 | | |
| triethanolamine | | | 1* | | | | 1* | |
| diethylene glycol monobutyl ether | | | 10* | | | 10* | | |

*78.5 hr

The foregoing tests resulted in the identification as useful finishing agents of water-miscible aliphatic organic compounds containing a plurality, preferably 2 to 4, alcoholic hydroxy substituents and a molecular weight of up to about 250, preferably up to about 150. In addition, polyethylene glycols having number-average molecular weights in the range of about 1000 to about 200,000, preferably about 1000 to about 10,000, were identified as finishing agents that caused substantially no damage when contacted with the photoconductive surface. This was a highly surprising result, given the extensive crazing produced by polyethylene glycol having a number-average molecular weight of 600.

Representative finishing agents in accordance with the present invention include but are not limited to the following compounds:

| Name | Formula | Mol. Wt. |
|---|---|---|
| ethylene glycol | $HOCH_2CH_2OH$ | 62 |
| diethylene glycol | $H(OCH_2CH_2)_2OH$ | 106 |
| triethylene glycol | $H(OCH_2CH_2)_3OH$ | 150 |
| tetraethylene glycol | $H(OCH_2CH_2)_4OH$ | 194 |
| dipropylene glycol | $H(OC_3H_7)_2OH$ | 134 |
| neopentyl glycol | $(HOCH_2)_2C(CH_3)_2$ | 104 |
| glycerol | $HOCH_2CH(OH)CH_2OH$ | 92 |
| propanediol (1,2; 1,3) | $C_3H_6(OH)_2$ | 76 |
| butanediol (1,2; 1,3; 1,4; 2,3) | $C_4H_8(OH)_2$ | 90 |
| 1,2,4-butanetriol | $HOCH_2CH(OH)CH_2CH_2OH$ | 106 |
| pentanediol (1,2; 1,4; 1,5; 2,4) | $C_5H_{10}(OH)_2$ | 104 |

-continued

| Name | Formula | Mol. Wt. |
|---|---|---|
| hexanediol (1,2; 1,5; 1,6; 2,5) | $C_6H_{12}(OH)_2$ | 118 |
| hexanetriol (1,2,3; 1,2,6) | $C_6H_{11}(OH)_3$ | 134 |
| 1,7-heptanediol | $HO(C_7H_{14})OH$ | 132 |
| 1,2,3-heptanetriol | $HOCH_2CH(OH)(CH_2)_4CH_2OH$ | 148 |
| octanediol (1,2; 1,8) | $C_8H_{16}(OH)_2$ | 146 |
| pentaerythritol | $C(CH_2OH)_4$ | 136 |
| tris(hydroxymethyl)-amine | $(HOCH_2)_3CNH_2$ | 121 |
| 2,2,-bis(hydroxy-methyl)propionic acid | $(HOCH_2)_2C(CH_3)COOH$ | 134 |
| polyethylene glycol | $H(OCH_2CH_2)_nOH$ | $M_n$~1K to 200K |

Preferred finishing agent compounds are: ethylene glycol, diethylene glycol, triethylene glycol, 1,2-propanediol, glycerol, 1,4-butanediol, 1,2,4-butanetriol, 1,5-pentanediol, 1,6-hexanediol, tris(hydroxymethyl)amine, and 2,2-bis (hydroxymethyl)propionic acid.

In accordance with the present invention, the preferred individual electroconductive fibers may comprise either a non-conductive core and a conductive sheath or, preferably, a conductive core and an insulating sheath. The conductive core can be formed from, carbon-loaded polyurethane core or carbon-loaded nylon. The insulating sheath can be formed from, for example, a polyester or a nylon. A preferred electroconductive fiber is the previously mentioned NO-SHOCKS® fiber, available from Solutia, Inc. and containing a carbon-loaded Nylon 6 core and an insulative sheath of Nylon 6,6.

The invention has been described in detail with particular reference to certain preferred embodiments thereof, but it is understood that variations and modifications can be effected within the spirit and scope of the invention, which is defined by the following claims.

What is claimed:

1. A photoreceptor cleaning brush for use in an electrostatographic imaging apparatus, said cleaning brush comprising:

individual fibers treated with an externally applied finishing agent comprising a water-miscible aliphatic organic compound containing a plurality of alcoholic hydroxy substituents, said finishing agent being selected from the group of compounds having a molecular weight of up to about 250 and polyethylene glycols having a number-average molecular weight of about 1000 to about 200,000.

2. The cleaning brush according to claim 1 wherein said finishing agent contains 2 to 4 alcoholic hydroxy substituents.

3. The cleaning brush according to claim 1 wherein said organic compound has a molecular weight of up to about 150.

4. The cleaning brush according to claim 1 wherein said organic compound further includes a carboxy substituent.

5. The cleaning brush according to claim 1 wherein said organic compound further includes an amino substituent.

6. The cleaning brush according to claim 1 wherein said organic compound is a polyethylene glycol having a number-average molecular weight of about 1000 to about 10,000.

7. The cleaning brush according to claim 1 wherein said organic compound is selected from the group consisting of ethylene glycol, diethylene glycol, triethylene glycol, tetraethylene glycol, dipropylene glycol, neopentyl glycol, glycerol, 1,2-propanediol, 1,3-propanediol, 1,2-butanediol, 1,3-butanediol, 1,4-butanediol, 2,3-butanediol, 1,2,4-butanetriol, 1,2-pentanediol, 1,4-pentanediol, 1,5-pentanediol, 2,4-pentanediol, 1,2-heyanediol, 1,5-hetanedsol, 1,6-hexanediol, 2,5-hexanediol, 1,2,3-hexanetriol, 1,2,6-hexanetriol, 1,7-heptanediol, 1,2,3-heptanetriol, 1,2-octanediol, 1,8-octanediol, pentaerythritol, tris(hydroxymethyl)amine, and 2,2-bis(hydroxymethyl) propionic acid.

8. The cleaning brush according to claim 7 wherein said organic compound is selected from the group consisting of ethylene glycol, diethylene glycol, triethylene glycol, 1,2-propanediol, glycerol, 1,4-butanediol, 1,2,4-butanetriol, 1,5-pentanediol, 1,6-hexanediol, tris(hydroxymethyl)amine, and 2,2-bis(hydroxymethyl)propionic acid.

9. The cleaning brush according to claim 1 wherein said individual fibers are electroconductive fibers.

10. The cleaning brush according to claim 9 wherein said electroconductive fibers each comprises a non-conductive core and a conductive sheath.

11. The cleaning brush according to claim 9 wherein said electroconductive fibers each comprises a conductive core and an insulating sheath.

12. The cleaning brush according to claim 11 wherein said conductive core is selected from the group consisting of a carbon-loaded polyurethane core and a carbon-loaded nylon core.

13. The cleaning brush according to claim 11 wherein said insulating sheath is selected from the group consisting of a polyester sheath and a nylon sheath.

14. The cleaning brush according to claim 11 wherein said conductive core is formed from carbon-loaded Nylon 6 and said insulating sheath is formed from Nylon 6,6.

15. The cleaning brush according to claim 1 wherein said conductive fibers comprise the cut plush pile of a woven fabric.

16. The cleaning brush of claim 15 further comprising a cylindrical core having bound thereto said cut plush pile of said woven fabric.

17. The cleaning brush according to claim 1 wherein said finishing agent is applied to said fibers by immersing said fibers in a bath containing said finishing agent or by contacting said fibers with a roller containing said finishing agent.

18. An improved elecotrstatographic imaging apparatus that includes a photoconductive imaging element and an electrostatic cleaning brush, the improvement comprising:

the photoconductive imaging element including a photoconductive surface portion comprising a polycarbonate binder resin, and the electrostatic cleaning brush comprising individual electroconductive fibers treated with an externally applied finishing agent comprising a water-miscible aliphatic organic compound containing a plurality of alcoholic hydroxy substituents, said organic compound being selected from the group of compounds having a molecular weight of up to about 250 and polyethylene glycols having a number-average molecular weight of about 1000 to about 200,000;

wherein said cleaning brush removes toner from said photoconductive surface portion of said imaging element without causing damage to said photoconductive surface portion.

19. The improved electrostatographic imaging apparatus according to claim 18 wherein said photoconductive surface portion further comprises a polyester binder resin.

20. The improved electrostatographic imaging apparatus according to claim 18 wherein said photoconductive imaging element comprises a drum.

21. The improved electrostatographic imaging apparatus according to claim 18 wherein said organic compound contains 2 to 4 alcoholic hydroxy substituents.

22. The improved electrostatographic imaging apparatus according to claim 18 wherein said organic compound has a molecular weight of up to about 150.

23. The improved electrostatographic imaging apparatus according to claim 18 wherein said organic compound further includes a carboxy substituent.

24. The improved electrostatographic imaging apparatus according to claim 18 wherein said organic compound further includes amino substituent.

25. The improved electrostatographic imaging apparatus according to claim 18 wherein said organic compound is a polyethylene glycol having a number-average molecular weight of about 1000 to about 10,000.

26. The improved electrostatographic imaging apparatus according to claim 18 wherein said organic compound is selected from the group consisting of ethylene glycol, diethylene glycol, triethylene glycol, tetraethylene glycol, dipropylene glycol, neopentyl glycol, glycerol, 1,2-propanediol, 1,3-propanediol, 1,2-butanediol, 1,3-butanediol, 1,4-butanediol, 2,3-butanediol, 1,2,4-butanetriol, 1,2-pentanediol, 1,4-pentanediol, 1,5-pentanediol, 2,4-pentanediol, 1,2-hexanediol, 1,5-hexanediol, 1,6-hexanediol, 2,5-hexanediol, 1,2,3-hexanetriol, 1,2,6-hexanetriol, 1,7-heptanediol, 1,2,3-heptanetriol, 1,2-octanediol, 1,8-octanediol, pentaerythritol, tris (hydroxymethyl)amine, and 2,2-bis(hydroxymethyl) propionic acid.

27. The improved electrostatographic imaging apparatus according to claim 26 wherein said organic compound is selected from the group consisting of ethylene giycol, diethylene glycol, triethylene glycol, 1,2-propanediol, glycerol, 1,4-butanediol, 1,2,4-butanetriol, 1,5-pentanediol, 1,6-hexanediol, tris(hydroxymethyl)amine, and 2,2-bis (hydroxymethyl)propionic acid.

28. The improved electrostatographic imaging apparatus according to claim 18 wherein said individual fibers are electroconductive fibers.

29. The improved electrostatographic imaging apparatus according to claim 28 wherein said electroconductive fibers each comprises a conductive core and an inssulating sheath.

30. The improved electrostatographic imaging apparatus according to claim 29 wherein said conductive core is selected from the group consisting of a carbon-loaded polyurethane core or a carbon-loaded nylon core, and said insulating sheath is selected from the group consisting of a polyester sheath or a nylon sheath.

31. The improved electrostatographic imaging apparatus according to claim 30 wherein said conductive core is formed from carbon-loaded Nylon 6 and said insulating sheath is formed from Nylon 6,6.

32. The improved electrostatographic imaging apparatus according to claim 18 wherein said conductive fibers comprise the cut plush pile of a woven fabric.

33. The improved electrostatographic imaging apparatus of claim 32 further comprising a cylindrical core having bound thereto said cut plush pile of said woven fabic.

34. The improved electrostatographic imaging apparatus according to claim 18 wherein said finishing agent is applied to said fibers by immersing said fibers in a bath containing said finishing agent or by contacting said fibers with a roller containing said finishing agent.

* * * * *